United States Patent [19]

Murphy

[11] Patent Number: 4,783,862

[45] Date of Patent: Nov. 15, 1988

[54] STRETCHER

[76] Inventor: Wendy J. Murphy, 48 Southvale Drive, Toronto, Ontatio, Canada, M4G 1G3

[21] Appl. No.: 151,950

[22] Filed: Feb. 3, 1988

[51] Int. Cl.[4] ..... A61G 1/00

[52] U.S. Cl. ..... 5/82 R; 224/157; 224/158

[58] Field of Search ..... 5/82 R; 224/151, 155, 224/156, 157, 158; 294/140

[56] References Cited

U.S. PATENT DOCUMENTS 2,351,146 6/1944 Pike ..... 5/82 R 2,899,692 8/1959 Finken ..... 5/82 R

FOREIGN PATENT DOCUMENTS 147006 7/1902 Fed. Rep. of Germany ..... 5/82 R

*Primary Examiner*—Alexander Grosz

*Attorney, Agent, or Firm*—Fetherstonhaugh & Co.

[57] ABSTRACT

A rescue stretcher for use in evacuating a number of babies from a hospital or the like comprises a stretcher which has a plurality of pockets located on the patient support surface thereof at spaced intervals along the length thereof. Each pocket is proportioned to accommodate at least one baby. The pockets are preferably arranged so that they all open toward one end of the stretcher.

20 Claims, 2 Drawing Sheets

STRETCHER

Figure 1:
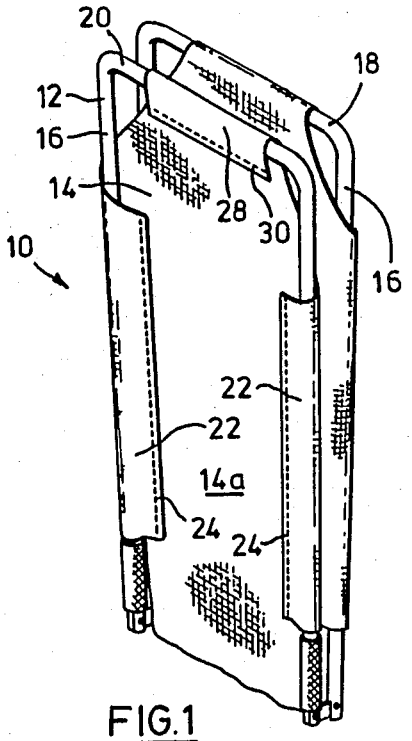

This invention relates to stretchers. In particular, this invention relates to a rescue stretcher which is designed to accommodate a plurality of babies.

PRIOR ART

A major concern in a pediatric hospital is the difficulty which is experienced in attempting to evacuate babies under emergency conditions such as in the event of a fire. At the present time, the conventional evacuation drill calls for the attending staff to bundle the babies individually and to pick up and physically carry a number of babies from the evacuation site to safety. This practice is very hazardous to the babies which are being transported and to the attendent. Babies and particularly premature babies tend to lose their body heat rapidly when removed from a temperature controlled environment. In addition, the wrapping or bundling which is carried out in an emergency situation is likely to greatly slow the rate at which evacuation can be carried out and this in itself can reduce the likelihood of successful evacuation. The number of babies that can be evacuated by any one attendant is also very limited.

Stretchers are frequently designed in order to accommodate a single patient in a supine position. A number of stretchers have been designed which have flaps which can be folded over a patient to protect the patient. One such device is illustrated in U.S. Pat. No. 4,124,908, Burns et al, dated Nov. 4, 1978. Devices of this type have been available for some considerable time, however, they are designed to be fitted around the patient after the patient has been positioned on the stretcher support surface in a supine position. They do not provide a pocket into which more than one patient can be inserted rapidly to be accommodated therein for transportation.

It is an object of the present invention to provide a rescue stretcher for babies which is capable of accommodating a plurality of babies for transportation therewith during a rescue operation.

It is a further object of the present invention to provide a stretcher for evacuating a plurality of babies wherein a plurality of pockets are formed on the stretcher and each pocket is proportioned to accommodate at least one baby.

It is a still further object of the present invention to provide a stretcher for babies which has a plurality of pockets formed thereon and each pocket is provided with a size-adjusting device which permits the size of the pocket to be adjusted to closely conform to the size of the occupant or occupants.

According to one aspect of the present invention, there is provided in a stretcher of the type having a patient support member which has a longitudinally elongated support face, the improvement of a plurality of pockets formed on the patient support face at spaced intervals along the length thereof, each pocket being proportioned to accommodate at least one baby whereby a plurality of babies can be accommodated in the pockets of the stretcher for mass evacuation purposes.

According to a further aspect of the present invention, there is provided a stretcher for babies comprising a perimeter frame having oppositely disposed side rails extending longitudinally thereof and first and second end rails extending transversely between adjacent ends of the side rails, a patient support membrane mounted on said perimeter frame and extending between the side rails and between the end rails, said membrane having an upper face, a plurality of pocket forming membranes each of which is attached to the patient support membrane and cooperates therewith to form a pocket which is proportioned to accommodate at least one baby.

Figure 3:
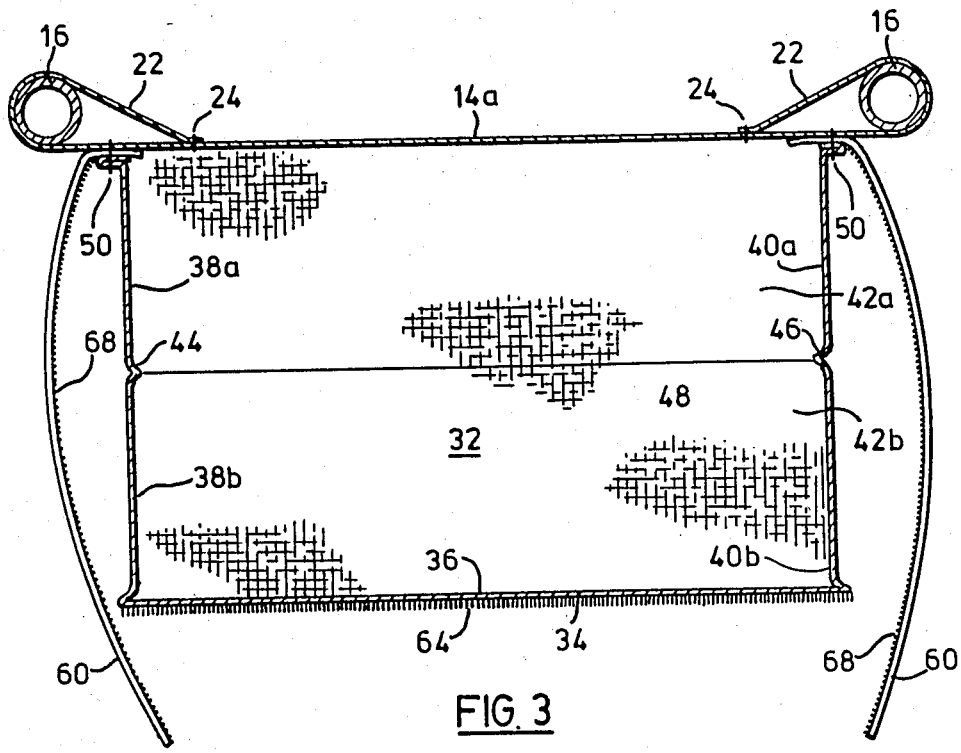
Figure 2:
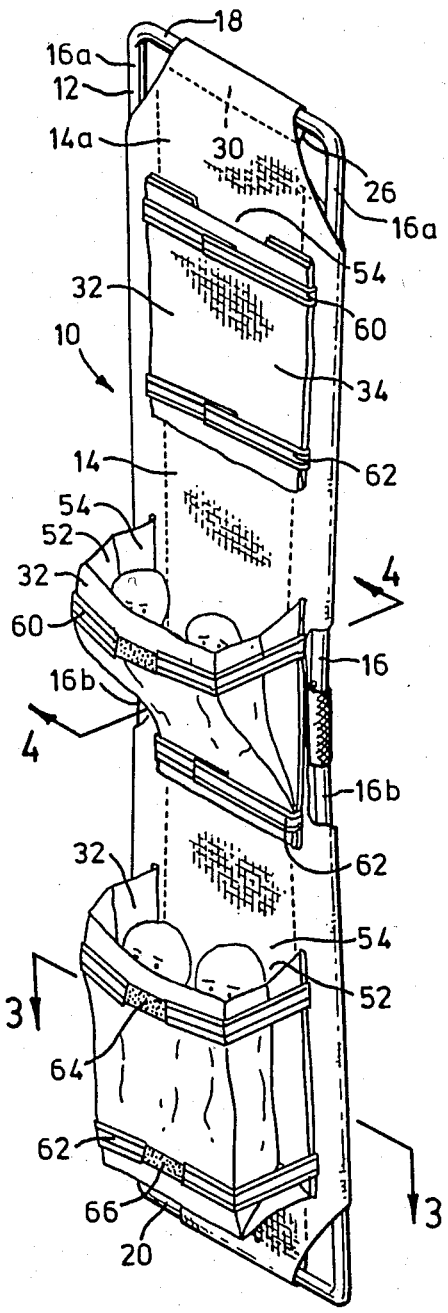
Figure 4:
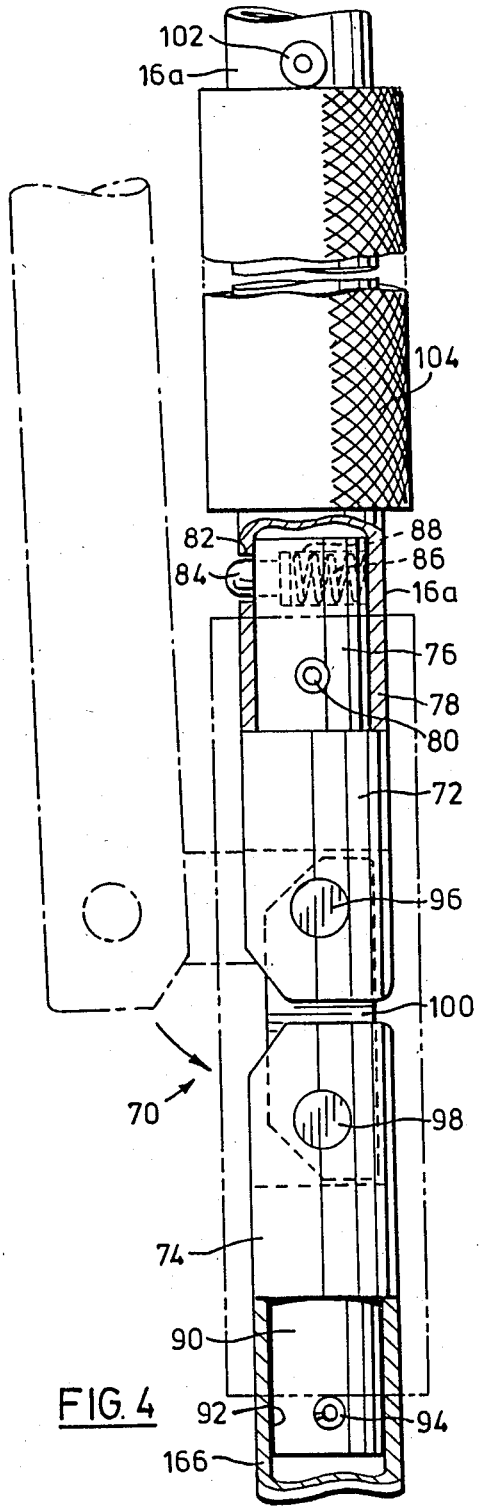

The invention will be more clearly understood after reference to the following detailed specification read in conjunction with the drawings wherein;

FIG. 1 is a pictorial view of a stretcher constructed in accordance with an embodiment of the present invention in which the stretcher frame is folded to a storage configuration, FIG. 2 is a pictorial view of a stretcher in its extended configuration showing three positions of its pockets, FIG. 3 is a sectional view taken along the line 3—3 of FIG. 2, FIG. 4 is an enlarged partially sectioned side view of the joint formed between the adjacent sections of the stretcher frame taken generally in the direction of the arrow 4 of FIG. 2.

With reference to FIGS. 1 and 2 of the drawings, the reference numeral 10 refers generally to a rescue stretcher constructed in accordance with an embodiment of the present invention. The rescue stretcher 10 comprises a perimeter frame generally identified by the reference numeral 12 and a patient support panel which is generally identified by the reference numeral 14. The perimeter frame 12 may be in the form of a light weight tubular member such as an aluminum tube. Because the stretcher will only be used for the purposes of transporting a limited number of relatively light babies, the frame need not have a great degree of structural strength and may be made from metal, plastics or any other suitable material. The frame 12 comprises a pair of longitudinally extending side rails 16 and first and second end rails 18 and 20.

The patient support panel 14 is in the form of a sheet of fabric which has flaps 22 which are folded over the side rails 16 and are stitched to the central panel **14*a* along stitch lines 24. Similarly, flaps 26 and 28 are folded over the end rails 18 and 22 and are stitched along stitch lines 30 to the central panel 14*a***.

Accommodation for babies is provided in the form of three pockets 32 which are positioned at spaced intervals along the central support panel **14*a*. The pockets are of identical construction and each is formed by attaching a pocket panel 34 to the central panel 14*a*. Each pocket panel 34 consists of an outer panel 36, gusset side panels 38*a*, 38*b* and 40*a*, 40*b* and bottom gusset panels 42*a*, 42*b*. The gusset side panels 38*a* and 38*b* are foldable along a central crease line 44 and the gusset side panels 40*a*, 40*b* are foldable along a central crease line 46. The bottom gusset panels 42*a*, 42*b* are foldable along the central crease line 48. The pocket panels 34 are connected to the central panel 14*a* along stitch lines 50 which connect the free ends of the gusset side panels 38*a* and 40*a* to the central panel 14*a*. Each pocket 32 has a storage compartment 52 formed therein which has an open end 54 which opens toward the first end rail 18 so that all of the open ends 54 open in the same direction. This serves to permit the attendents who are transporting the stretcher to tilt the stretcher so that the end rail 20 is located at a level below the end rail 18** without creating a tendency to spill the contents of the one of the pockets. This is of particular importance when it is considered that a stretcher of this type is likely to be used for transporting babies down a stairway or lowering the stretcher from a window of a building.

The size of the storage compartment 52 of each pocket 32 can be adjusted by means of size adjustment straps 60 and 62. Bands 64 and 66 of a fastening material such as VELCRO (Trade Mark) are attached to and extend transversely across the outer face of the outer panel 36. The straps 60 and 62 each have a layer of a complimentary fastening material 68 on their inner face which serves to permit the straps 60 to be secured with respect to the fastener band 60 for at any required position along their length in order to control the degree of expansion of the pocket. The inner ends of the size adjustment straps 60 and 62 are secured to the central panel 14*a* by the same stitching as that used to secure the gusset side panels 38*a* and 40*a* along the seamline 50.

The pockets 32 are preferably made from a fabric material which like the support panel 14 has thermal insulating characteristics so that when a baby is positioned in the pocket, the body heat of the baby will be conserved. The fabric or material from which the pockets and the patient support panel are made is also preferably a fire retardent material. A suitable material for use in the manufacture of the patient support panel 14 is an 18 oz. sheet of plastics material which is impregnated with aluminum to form a thermally insulated web. A suitable material for this purpose is available from Braun Plastics Company Inc., and is identified by the trade name Es100. A 10 oz. sheet of a similar material may be used to form the pockets and is also available from B.P.C.I. and is identified by the trade name ES200. This material is a laminate which consists of a packing web of vinyl and a polyester film such as Mylar (TM), the polyester film being impregnated with aluminum.

As shown in FIG. 2 of the drawings, the pockets 32 can be arranged in a flat storage configuration and may be retained in this position by means of the straps 60 and 62. The pocket may also be located in a partially open position as shown in the centrally located pocket in FIG. 2 or in the fully open position as shown in the lower pocket. These positions are achieved by adjusting the positions of the straps 60 and 62. The particular proportions of the pocket when in an open position will be determined by the size of the babies which are to be transported therein and may be adjusted by the rescue personnel in order to ensure that the babies are snugly located in the storage compartment 52 so as to conserve body temperature and provide for the safe transportation of the babies.

In order to reduce the size of the stretcher when it is not in use, the frame 16 is formed in two sections which are hingedly connected. Each section has a U-shaped configuration. One of these sections is formed by the end rail 18 and the lengths 16*a* of the side rails. The other section is formed by the end rail 20 and the lengths 16*b* of the side rails. The hinge mechanism which is used to connect the ends of the sections 16*a* and 16*b* is shown in detail in FIG. 4 of the drawings and is generally identified by the reference numeral 70. The hinge 70 comprises a pair of hinge posts 72 and 74. The hinge post 72 has a plug portion 76 which is seated in the bore 78 of the end of the side rail section 16 and is secured therein by means of a dowel pin 80. Opposite ends of the dowel pin 80 are flush with the outer surface of the tubular rail 16*a*. A passage 82 opens radially from the bore 78. A locking detent pin 84 is mounted in the plug portion 76 and projects radially outwardly therefrom through the passage 82. A compression spring 86 is seated in a bore 88 which is formed in the plug portion 76 and serves to bear against the pin 84 to normally urge it to the extended position shown in FIG. 4. The pin 84 can be depressed to a level below the outer surface of the tubular member 16*a* by compressing the spring 86. The post 74 has a plug portion 90 which is seated in the bore 92 which is formed in the end of the tubular member 16*b*. A dowel pin 94 serves to secure the plug portion 90 in the bore 92. The dowel pin 94 has a portion of its length projecting radially outwardly from the outer face of the tubular member 16*b*. The hinge posts 72 and 74 are connected to one another by means of a hinge plate 100. The hinge plate 100 is pivotally connected to the post 72 by means of a pivot pin 96 and to the post 74 by means of a pivot pin 98.

A dowel pin 102 projects through one of the side rail 16*a* and is spaced from the detent pin 84 a sufficient distance to accommodate a locking sleeve 104 therebetween. The dowel pin 102 projects radially outwardly from the tubular member 16*a* to a sufficient extent to limit the movement of the locking sleeve 104 in one direction. When the detent pin 84 is in its extended position, it will serve to limit the movement of the sleeve 104 in its other longitudinal direction. The sleeve 104 fits in a free-fitting sliding relationship over the tubular member 16*a* and over the hinge posts 72 and 74.

To secure the stretcher in the extended position shown in FIG. 2, the locking sleeve 104 is moved from the position shown in solid lines in FIG. 4 to the position shown in broken lines in FIG. 4. This is achieved by manually depressing the detent pin 84 and sliding the sleeve 104 along the tubular member 16*a* until it assumes a position in which it is located between the detent 84 and the dowel pin 94. The detent pin 84 is then returned to its extended position by the compression spring 86 and will cooperate with the dowel pin 94 to retain the sleeve 104 in the position in which it serves to retain the hinge 70 in the extended position. When the stretcher is to be folded for storage purposes, the detent pin 84 is compressed and the sleeve 104 is returned to its storage position shown in solid lines in FIG. 4.

In use the baby transporting stretcher will normally be stored in the compact folded configuration illustrated in FIG. 1 of the drawings. When it is necessary to use the stretcher, it will be unfolded to assume the extended position shown in FIG. 2 and the locking sleeves 104 will be positioned to retain the hinge 76 in its extended position so that the stretcher can be carried in the extended position by supporting opposite ends thereof. One or both of the fastening straps 60, 62 will then be released to permit the pockets 32 to expand to the extent required to accommodate the babies according to the size of the babies which are to be transported thereby. Generally, two babies each weighing about 10 lbs. can be accommodated in each pocket. The babies can be easily and quickly positioned in the pockets and the securing straps can be adjusted to provide the required size of pocket to ensure that the babies are snugly retained therein prior to transportation. It will be apparent that the stretcher illustrated in the drawings is capable of accommodating and supporting six babies, two to each pocket in a manner which will permit them to be easily transported to safety while providing for the retention of the body heat of the babies.

A typical stretcher may have a length between the end rails 18 and 20 of about 6′ and a width between the rails of about 15″. The tubular frame may have an external diameter of about 1". Each pocket may have a length of about 16" and a width of about 13". The gusset side panels and bottom panels may have an extended length of about 8". A stretcher of these proportions is capable of use for transporting six babies, two to each pocket, with ease. The fastening straps 60, 62 may have a width of about 2" and a length of about 10". The upper edge of the upper strap is spaced about 1" from the upper edge of its associated pocket and the lower edge of the lower strap is spaced about 4" from the lower edge of its associated pocket. The lower edge of the lowermost pocket is spaced about 3" from the bottom rail 20 and a 6" clearance is provided between the open end of each pocket and the lower edge of the adjacent pocket. The upper edge of the upper pocket is preferably spaced about 9" from the upper rail 18.

A reflective tape may be applied to various parts of the stretcher to facilitate the location of the stretcher when using emergency lighting. Preferably reflective tape is applied to the outer face of each strap 60 so that this upper fastening strap can be easily identified so that the attendant can easily recognize the upper end of the pockets.

Various modifications of the present invention will be apparent to those skilled in the art without departing from the scope of the invention. For example, the stretcher may be designed to provide two pockets, rather than three pockets or it may have four or more pockets, depending upon the overall proportions of the stretcher. In addition, the stretcher frame need not be a foldable frame. These and other modifications will be apparent to those skilled in the art.

I claim:

1. In a stretcher of the type having a patient support member which has a longitudinally elongated support face, the improvement of a plurality of pockets formed on the patient support face at spaced intervals along the length thereof, each pocket being proportioned to accommodate at least one baby whereby a plurality of babies can be accommodated in the pockets of the stretcher for mass evacuation purposes.

2. A stretcher as claimed in claim 1, further comprising size adjustment means associated with each pocket for adjusting the size of its associated pocket to closely confine babies located therein in use.

3. A stretcher as claimed in claim 1, wherein the stretcher has first and second ends at opposite ends of its longitudinal extent, said pockets each having an open end opening toward said first end such that if the second end of the stretcher is located at a lower level than the first end in use, the open ends of each pocket will open upwardly.

4. A stretcher as claimed in claim 1, wherein each pocket has a front panel, a bottom panel and a pair of oppositely disposed side panels, the bottom and side panels being gusset panels which allow the pocket to expand from a collapsed storage position to an expanded baby accommodating position.

5. A stretcher as claimed in claim 1, wherein the pockets are expandable for a collapsed position to an expanded position and wherein size adjustment means is provided in association with each pocket for adjusting the extent to which the bottom and side gusset panels may expand.

6. A stretcher as claimed in claim 1, wherein the patient support member and pockets are formed from a thermal insulating material which will serve to conserve the body heat of the babies during transportation.

7. A stretcher as claimed in claim 6, wherein the thermal insulating material is a fire retardent material.

8. A stretcher as claimed in claim 1, wherein the stretcher further comprises a longitudinally elongated frame having oppositely disposed side rails extending in a spaced parallel relationship and first and second end rails at opposite ends of the side rails, and a flexible membrane bridging the side and end rails.

9. A stretcher as claimed in claim 8, wherein the side rails are each formed in two sections which are hingedly connected to one another to permit the frame to fold upon itself to a compact storage configuration and wherein releaseable locking means is provided for securing the frame in an extended configuration.

10. A stretcher as claimed in claim 1, wherein at least three pockets are formed on said patient support face.

11. A stretcher as claimed in claim 10, wherein each pocket is proportioned to accommodate two premature babies whereby the pockets of the stretcher can accommodate six premature babies.

12. A stretcher as claimed in claim 2, wherein said size adjustment means comprises upper size adjustment means located adjacent to an open end of the pocket and lower size adjustment means spaced a substantial distance from the open end of each pocket, each size adjustment means being independently adjustable.

13. A stretcher for babies comprising;

(a) a perimeter frame having oppositely disposed side rails extending longitudinally thereof and first and second end rails extending transversely between adjacent ends of the side rails, (b) a patient support membrane mounted on said perimeter frame and extending between the side rails and between the end rails, said membrane having an upper face, (c) a plurality of pocket forming membranes each of which is attached to the patient support membrane and cooperates therewith to form a pocket which is proportioned to accommodate at least one baby.

14. A stretcher as claimed in claim 13, further comprising size adjustment means associated with each pocket for adjusting the size of its associated pocket to closely confine babies located therein in use.

15. A stretcher as claimed in claim 13, wherein each pocket forming membrane has a front panel, a bottom panel and a pair of oppositely disposed side panels, the bottom and side panels being gusset panels which allow the pocket to expand from a collapsed storage position in which the front panel extends in close proximity to the support membrane and an expanded baby accommodating position.

16. A stretcher as claimed in claim 13, wherein the pockets are expandable from a collapsed position to an expanded position and wherein size adjustment means is provided in association with each pocket for adjusting the extent to which the bottom and side gusset panels may expand.

17. A stretcher as claimed in claim 13, wherein the patient support member and pockets are formed from a thermal insulating material which will serve to conserve the body heat of the babies during transportation.

18. A stretcher as claimed in claim 13, wherein the thermal insulating material is a fire retardent material.

19. A stretcher as claimed in claim 13, wherein the side rails are each formed in two sections which are hingedly connected to one another to permit the frame to fold upon itself to a compact storage configuration and wherein releaseable locking means is provided for securing the frame in an extended configuration.

20. A stretcher as claimed in claim 13, wherein at least three pockets are formed on said patient support face.

* * * * *